United States Patent [19]

Hawkins, Jr.

[11] Patent Number: 4,578,131

[45] Date of Patent: Mar. 25, 1986

[54] METHOD OF MAKING A THREE DIMENSIONAL SCULPTURED PAINTING

[76] Inventor: Floyd A. Hawkins, Jr., Rte. 1, Box 476, Stanardsville, Va. 22973

[21] Appl. No.: 671,189

[22] Filed: Nov. 14, 1984

[51] Int. Cl.[4] ..... B44D 5/10

[52] U.S. Cl. ..... 156/62; 156/59; 427/270; 427/277; 427/356; 428/13; 428/454; 428/542.2; 428/913.3; 434/82; 434/84

[58] Field of Search ..... 30/164.9, 169; 156/59, 156/62; 427/271, 277, 356, 270; 428/13, 454, 478.2, 542.2, 913.3; 434/82, 84, 96

[56] References Cited

U.S. PATENT DOCUMENTS

| | | | |
|---|---|---|---|
| 1,991,996 | 2/1935 | Bakker | 427/270 |
| 2,269,740 | 1/1942 | Schwartz | 428/484 X |
| 3,744,152 | 7/1973 | Crasilneck | 156/59 X |
| 4,010,542 | 3/1977 | Richardson et al. | 30/164.9 |
| 4,349,588 | 9/1982 | Schiffer | 427/270 X |

*Primary Examiner*—Robert A. Dawson
*Attorney, Agent, or Firm*—Richard C. Litman

[57] ABSTRACT

A method of creating a three-dimensional sculptured painting, involving the use of a sand and white glue mixture spread over the entire painting canvas, and scored, built-up and sculptured over desired areas of the painting to create not only a physically three-dimensional product, but also providing a significantly enhanced optical three-dimensional effect for the viewer after application of the final paint layers.

3 Claims, 4 Drawing Figures

METHOD OF MAKING A THREE DIMENSIONAL SCULPTURED PAINTING

BACKGROUND OF THE INVENTION

1. Field of the Invention

Throughout life, one comes across many enjoyable scenes, either during everyday activities, or special vacation trips, which people have sought to remember. As imagination will sometimes fails us, people throughout the ages have sought different ways of capturing a scene more permanently than simply in our memory. Of these more permanent ways of capturing a scene, drawings, paintings, and photographs are the most common methods currently used. However, all three of these methods translate a three-dimensional view into a two-dimensional representation thereof, be it on paper for a drawing, a canvas for painting, or photographic paper for a photograph.

DESCRIPTION OF THE PRIOR ART

Numerous attempts have been made over the years to add a third dimension of depth to both paintings and photographs, but these attempts have met with little success. Most notably, three-dimensional photographic techniques have been developed, but most require the use of complex, expensive equipment, and often necessitate equally complex viewing mechanisms in order to achieve the three-dimensional effect. Three-dimensional painting has met with even less success than three-dimensional photography, and applicant is aware of little present activity in this area.

U.S. Pat. No. 3,744,152 to Crasilneck is the only prior art patent of which applicant is aware. This patent sets forth a method of creating bas-relief or mezzo-relievo types of art works in which glue and glue dots or chips are placed selectively on areas of a sketch to achieve a desired relief.

SUMMARY OF THE INVENTION

This invention is directed to a method and apparatus for creating a three-dimensional sculptured painting by applying a textured base coating to an entire canvas, sculpturing the details of the desired picture in the textured material, and finally applying a finish coating of paints in much the same manner as a standard work of art. The resulting product is not only three-dimensional physically, but due to the nature of the textured material used for the background, the optical three-dimensional affect is substantially enhanced over prior art processes.

DESCRIPTION OF THE PREFERRED EMBODIMENT

The method of creating a three-dimensional sculptured painting which applicant has developed includes two major steps: the application and sculpturing of a textured based material, and the application of the final paints, as in a normal painting.

Figure 1:
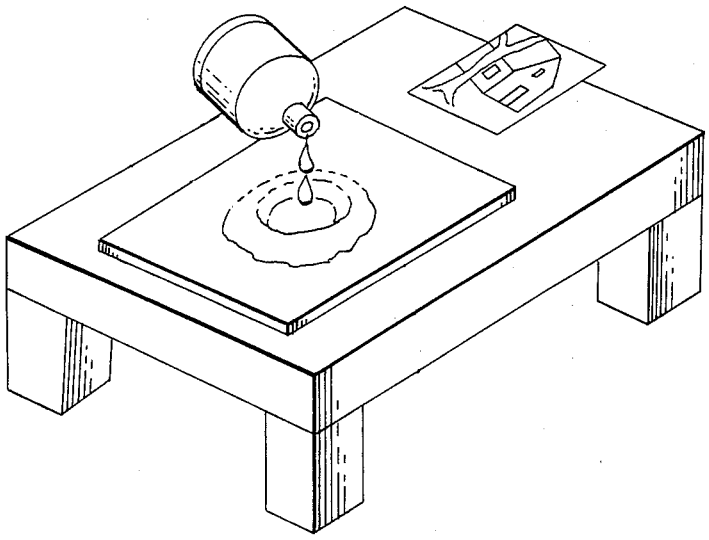
FIG. 1 is a perspective view of the initial mixing of the textured background coating.
Figure 2:
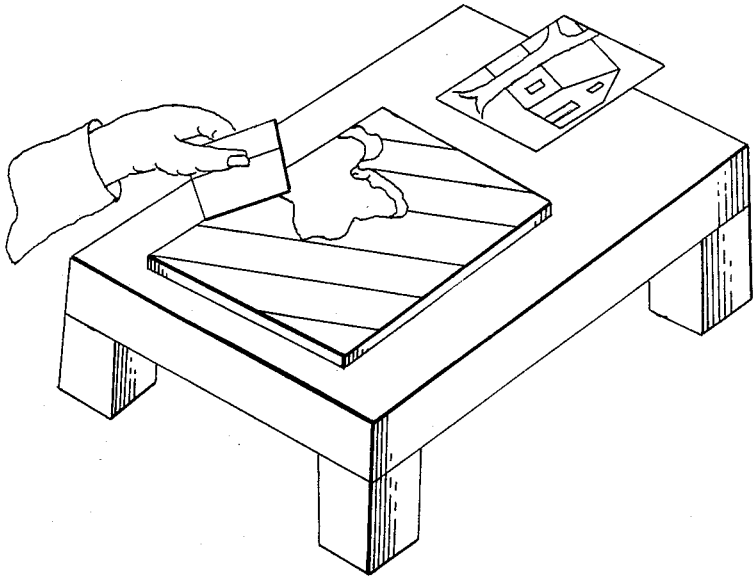
FIG. 2 illustrates initial spreading of the textured coating.

The particular textured background material is the key to the invention. One begins with a fiberboard board which is covered with cloth on one side. To the cloth-covered side is applied a mixture of white household glue and sand, as illustrated in FIG. 1. Applicant has found that the proper mixture proportions for a standard sized canvas are two parts medium grain sand to one part of white glue. These elements may be mixed with a spreading tool directly on the canvas, and are then spread evenly over the entire board as shown by FIG. 2. Ideally, this initial overall thickness of mixture should be one-eighth of an inch.

Figure 3:
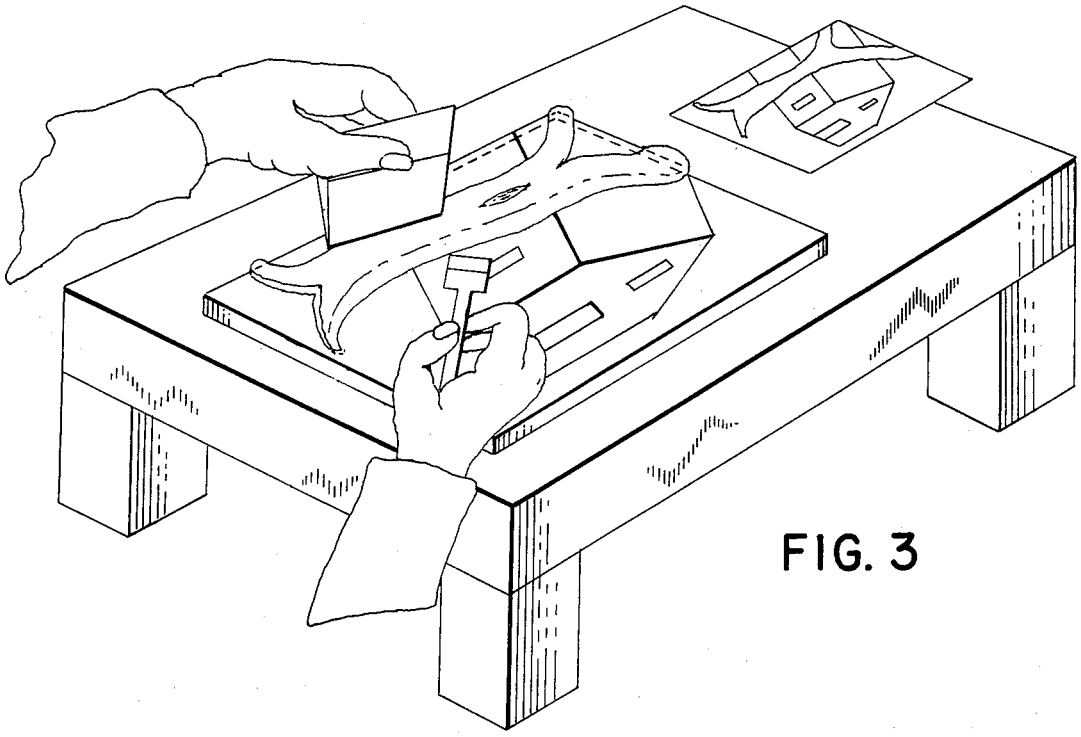
FIG. 3 illustrates the build-up of the textured background material to provide an outline of the major features of the painting.
Figure 4:
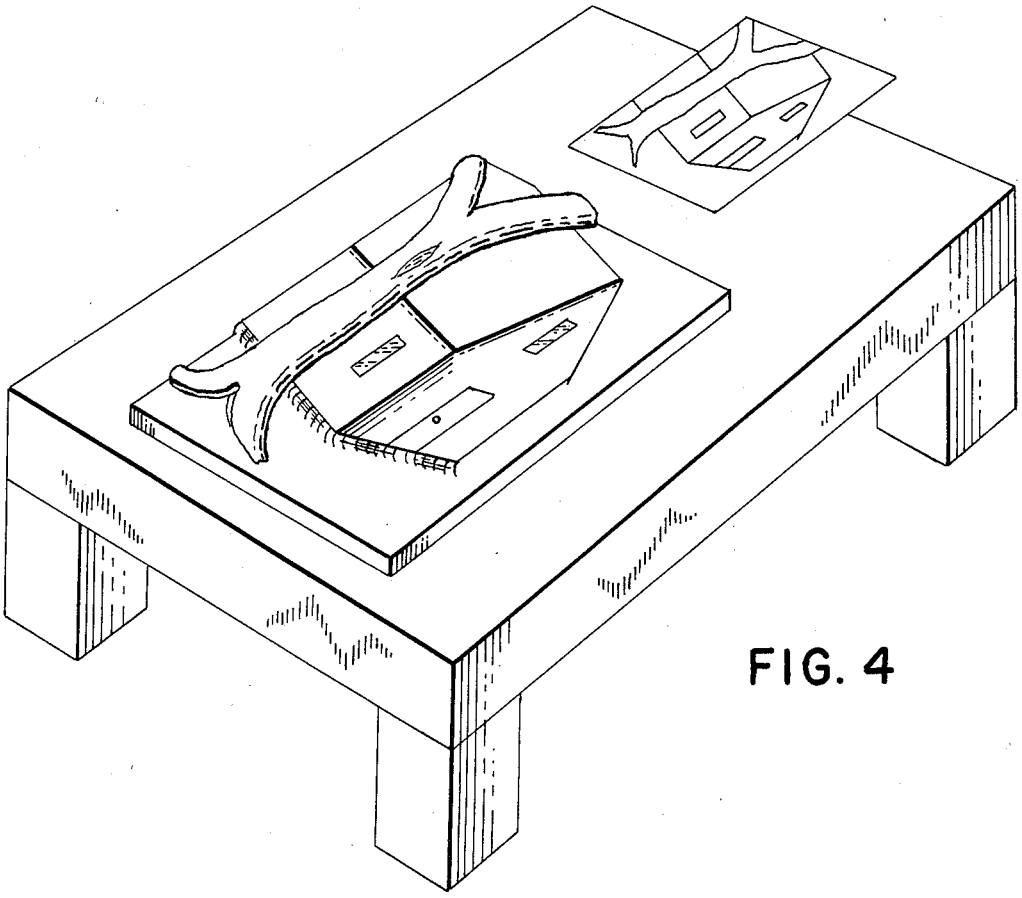
FIG. 4 shows the finished product prior to painting.

Referring next to FIG. 3, a scoring tool is used to outline the major features of the desired picture, and then an additional mixture of sand and glue, using more sand in the proportions this time, is applied and sculptured with sculpturing tools to add a third dimension of depth to desired elements in the foreground, at the artist's discretion. Using the thicker mixture, these desired areas may be built-up an additional one-quarter inch, for a total maximum thickness of three-eighths inch above the cloth backing material. The finished sculptured surface, ready for painting, is illustrated in FIG. 4.

Once the sculptured background is finished, and the board and its coating are allowed to dry for at least twenty-four hours, any normal painting medium may be used to complete the artwork. It is recommended that a primer coat be added to the background prior to the addition of the final colors, such as a water base primer in the case of acrylics, or an oil base primer if oil paints are to be used.

Once the painting is finished all paints are dry, a clear spray coating is also recommended for protection of the final work.

It is to be understood that the above description is merely the preferred embodiment of the invention, and that numerous variations and alterations can be made without departing from the spirit and scope of the invention as set forth in the appended claims.

I claim:

1. A method of creating a three dimensional sculptured painting comprising the steps of: securing a fabric to a fiberboard sheet; applying a base coat of a first sand and glue mixture to the fabric; scoring the base coat to define a picture; applying a second sand and glue mixture with a higher sand to glue ratio than said first mixture to desired portions of the defined picture to build up areas of the picture and sculpturing said second mixture to create three dimensional detail; and, after drying, painting the picture to complete the details of an object or scene which forms the picture.

2. The method as described in claim 1 wherein the base coat comprises a mixture of two parts of medium grain sand to one part of white glue.

3. The method of claim 1 wherein said second sand and glue mixture comprises more than two parts of medium grain sand to one part white glue.

* * * * *